US005310021A

United States Patent [19]

Hightower

[11] Patent Number: 5,310,021

[45] Date of Patent: May 10, 1994

[54] MOTOR-DRIVEN, SPRING-RETURNED ROTARY ACTUATOR

[75] Inventor: Peter C. Hightower, Belvidere, Ill.

[73] Assignee: Barber-Colman Company, Loves Park, Ill.

[21] Appl. No.: 18,813

[22] Filed: Feb. 18, 1993

[51] Int. Cl.[5] ..... F03G 1/08; F24F 7/00

[52] U.S. Cl. ..... 185/40 R; 251/69; 251/77; 454/257; 464/160

[58] Field of Search ..... 185/40 R; 251/69, 77; 454/257, 369; 464/160

[56] References Cited

U.S. PATENT DOCUMENTS

| | | | |
|---|---|---|---|
| 3,113,639 | 12/1963 | Koplar et al. | 185/40 |
| 3,114,216 | 12/1963 | Crawford et al. | 46/175 |
| 3,186,514 | 6/1965 | Wallqvist | 185/40 |
| 3,359,680 | 12/1967 | Lindsay | 46/206 |
| 3,610,369 | 10/1971 | Rodgers | 185/39 |
| 4,581,987 | 4/1986 | Ulicny | 454/369 |
| 4,595,081 | 6/1986 | Parsons | 185/40 R |
| 4,741,508 | 5/1988 | Fukamachi | 185/40 R |

*Primary Examiner*—Allan D. Herrmann
*Attorney, Agent, or Firm*—Leydig, Voit & Mayer

[57] ABSTRACT

An electric motor acts through a gear train to rotate an output shaft in one direction while a torsion spring rotates the shaft in the opposite direction when the motor is de-energized. When the output shaft stops abruptly at a limit position after being rotated by the spring, a lost-motion drive connection permits the output gear of the drive train to rotate relative to the shaft in order to dissipate kinetic energy through the gear train and to avoid impact loading of the gear train and the motor.

7 Claims, 3 Drawing Sheets

MOTOR-DRIVEN, SPRING-RETURNED ROTARY ACTUATOR

BACKGROUND OF THE INVENTION

This invention relates generally to a reversible rotary actuator and specifically to an actuator having an electric motor which is selectively operable to rotate an output shaft in one direction. During driving of the output shaft by the motor, a torsion spring is wound so as to store energy for rotating the shaft in the other direction when the motor is de-energized and the spring unwinds.

More particularly, the invention relates to a rotary actuator of the type in which the motor rotates the output shaft and winds the spring by way of a gear train which substantially reduces the speed and substantially amplifies the torque of the motor. When the spring unwinds to rotate the output shaft, the spring acts reversely through the gear train and backdrives the motor shaft.

An actuator of this type is frequently used to drive a utilization device such as a smoke and fire damper in the duct of a heating, ventilating and cooling system. When the motor is de-energized, the spring drives the output shaft in a direction moving the damper to a closed position against a fixed stop. During driving of the output shaft by the spring the gear train and the motor shaft are accelerated and develop substantial kinetic energy. When the damper is abruptly stopped, the gear train and the motor shaft are subjected to impact loading unless the kinetic energy is dissipated. In prior actuators of this type, friction clutches have been used to dissipate the kinetic energy as heat. Such clutches, however, are relatively complex and expensive and substantially increase the cost of a comparatively small and low torque actuator.

SUMMARY OF THE INVENTION

The general aim of the present invention is to provide an actuator of the above general type in which kinetic energy, upon stopping of the output shaft, is dissipated through the gear train itself so as to avoid impact loading of the gear train and the motor shaft without need of utilizing relatively expensive components for this purpose.

A more detailed object of the invention is to achieve the foregoing by providing a lost-motion drive connection between the output shaft and the final output gear of the gear train. The lost-motion connection is effective to cause the output gear to drive the output shaft in one direction when the motor is energized and to enable the spring acting on the output shaft to drive the output gear in the opposite direction when the motor is de-energized. When the output shaft is abruptly stopped, the lost-motion connection enables the output gear to continue to rotate and to take advantage of the inherent friction in the gear train to dissipate kinetic energy imparted to the gear train by the spring.

These and other objects and advantages of the invention will become more apparent from the following detailed description when taken in conjunction with the accompanying drawings.

DETAILED DESCRIPTION OF THE PREFERRED EMBODIMENTS

Figure 1:
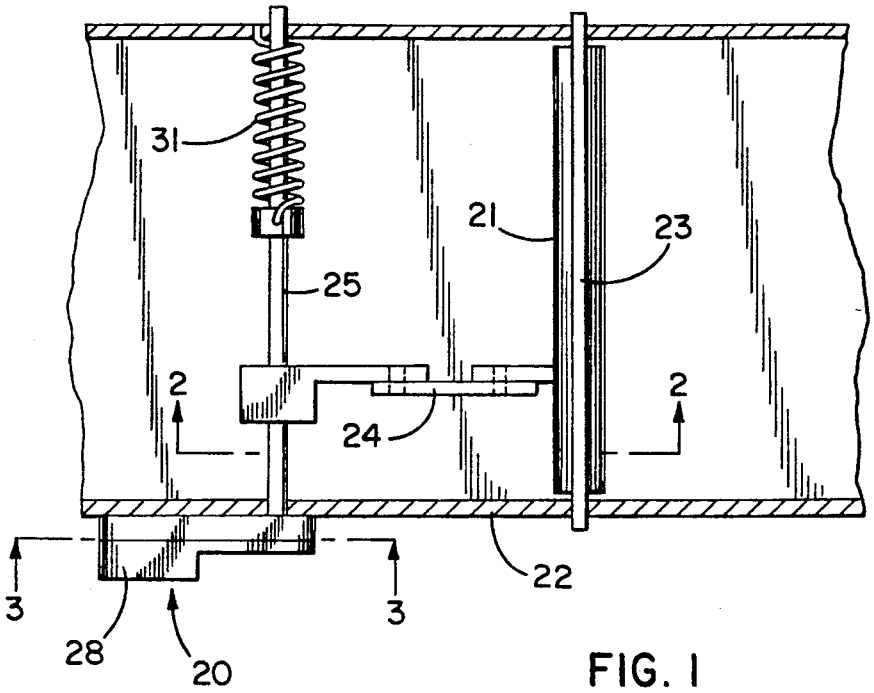
FIG. 1 is a schematic cross-sectional view showing a typical utilization device equipped with a new and improved actuator incorporating the unique features of the present invention.

As shown in the drawings for purposes of illustration, the invention is embodied in a reversible rotary actuator 20 for controlling the position of a utilization device 21. In this particular instance, the utilization device has been shown as being a smoke and fire damper located in a heating, ventilating and air conditioning duct 22 and mounted on a shaft 23 for turning through if approximately 90 degrees between a fully closed upright position (FIG. 2) and a fully open horizontal position. A toggle linkage 24 is connected between the damper 21 and a shaft 25 which is journaled in the side walls of the duct 22. The damper is closed and opened when the shaft 25 is rotated clockwise (FIG. 2) and counterclockwise, respectively. When the damper reaches its fully closed position, it hits against a fixed stop 26 which has been shown schematically in FIG. 2 as being located within the duct. The damper hits a second stop 27 when it is in its fully open position.

Figure 4:
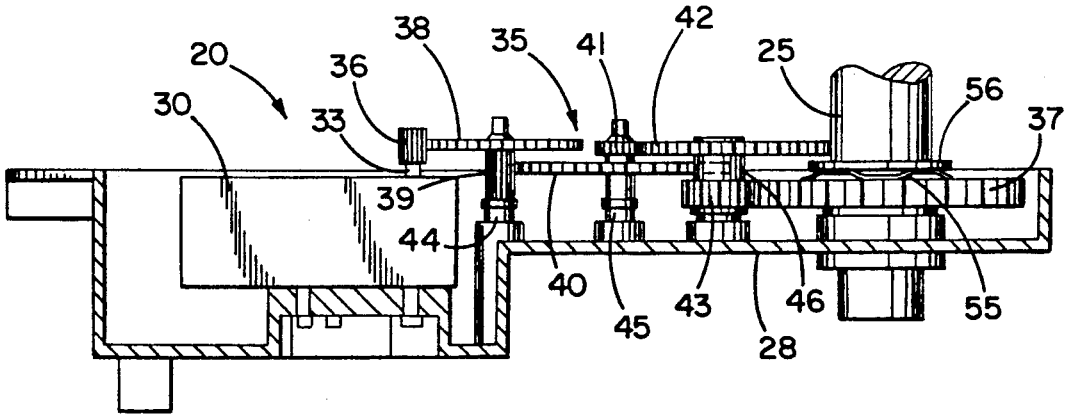
FIG. 4 is an enlarged top plan view of the actuator shown in FIG. 1 with certain parts broken away and shown in section.

The actuator 20 includes a housing 28 secured to the outer side of one of the side walls of the duct 22 and rotatably journaling one end portion of the shaft 25, that shaft hereafter being referred to as an output shaft. Driving of the output shaft 25 in a counterclockwise direction (FIG. 2) to open the damper 21 is effected by a relatively low torque and selectively energizable electric motor 30 (FIG. 4) located in the housing 28. As the output shaft 25 is rotated counterclockwise, a torsion spring 31 (FIG. 1) is loaded or wound and serves to rotate the shaft in a clockwise direction in order to close the damper when the motor is de-energized. Herein, the torsion spring has been shown as being located within the duct and connected between the output shaft and one of the side walls of the duct. It will be appreciated, however, that the spring could be located within the actuator housing 28 and connected between the output shaft and part of the housing.

Figure 3:
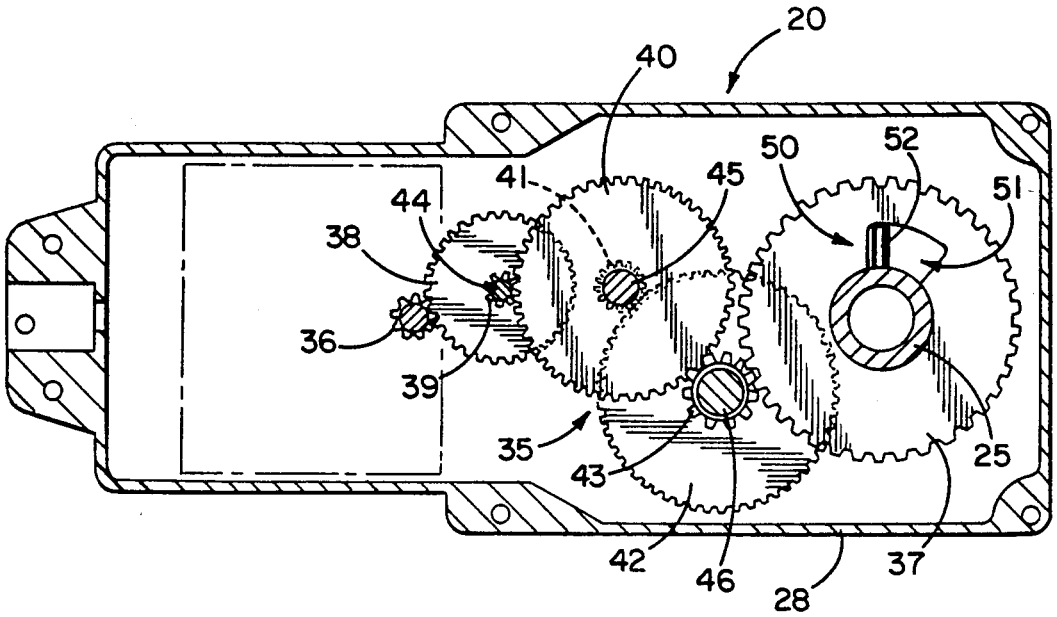
FIG. 3 is an enlarged cross-section taken substantially along the line 3—3 of FIG. 1.

The motor 30 includes a drive shaft 33 (FIG. 4) and, as mentioned above, is of relatively low torque. The drive shaft of the motor is connected to the output shaft 25 by a drive or gear train 35 (FIGS. 3 and 4) which causes the output shaft to rotate at a substantially slower speed than the motor drive shaft and to be capable of exerting substantially higher torque than the motor drive shaft.

In this instance, the gear train 35 includes a small input gear member 36 (FIGS. 3 and 4) rotatable with the motor shaft 33, a large output gear member 37 coaxial with the output shaft 25 and six intermediate gears 38–43 in driving relationship with the input and output gears. Intermediate large gear 38 meshes with the input gear 36 and rotates conjointly with intermediate small gear 39 on a pin 44 in the housing 28. A second pin 45 in the housing rotatably supports large and small conjointly rotatable intermediate gears 40 and 41, the large gear 40 meshing with the gear 39. The small intermediate gear 41 meshes with large intermediate gear 42 which is conjointly rotatable with small intermediate gear 43 on a pin 46. The intermediate gear 43 meshes with the final output gear 37.

Figure 2:
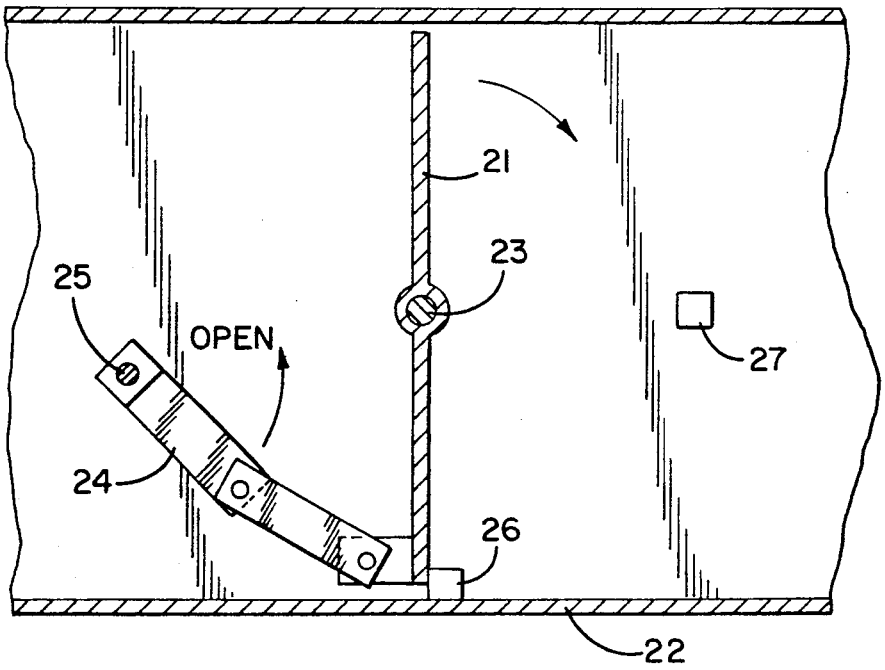
FIG. 2 is a cross-section taken substantially along the line 2—2 of FIG. 1.

To explain the operation of the actuator 20 as described thus far, assume that the damper 21 is in its closed position shown in FIG. 2 and that the motor 30 is de-energized. Now assume that a control signal causes the motor to be energized so as to effect counterclockwise rotation of the motor drive shaft 36. That shaft acts through the gear train 35 to rotate the output shaft 25 in a counterclockwise direction. Counterclockwise rotation of the output shaft swings the damper toward its open position and, at the same time, winds the torsion spring 31. The damper opens until it hits the stop 23, at which time the motor remains energized but goes to a stalled condition.

Now assume that the motor 30 is de-energized, either by a control signal or by loss of electrical power during a fire. Upon de-energization of the motor, the torsion spring 31 unwinds and rotates the output shaft 25 clockwise to close the damper 21. When the damper closes fully and hits the stop 26, the output shaft comes to an abrupt stop.

In accordance with the present invention, the motor 30 and the gear train 35 are isolated from shock loads resulting from abrupt stopping of the spring-powered output shaft 25 by dissipating kinetic energy through the gear train itself. This is achieved through the unique provision of an extremely simple lost-motion drive connection 50 (FIG. 3 and FIGS. 5–7) between the output shaft 25 and the output gear 37 to enable the output gear to continue to rotate after the output shaft has been stopped.

More specifically, the output gear 37 is supported to rotate on the output shaft 25 rather than being fixed to rotate with the output shaft. In the preferred embodiment shown in FIGS. 1–7, the lost-motion drive connection 50 includes an angularly extending slot 51 formed through a portion of the output gear 37 between the inner and outer peripheries thereof, the slot opening radially out of the inner periphery of the gear. The lost-motion drive connection further comprises a projection 52 (herein, in the form of a pin) fixed rigidly to the output shaft 25 and projecting radially from the shaft and into the slot. The angular dimension of the pin 52 is significantly less than the angular dimension of the slot 51 and thus there is substantial angular clearance between the pin and the ends 53 and 54 of the slot.

Figure 5:
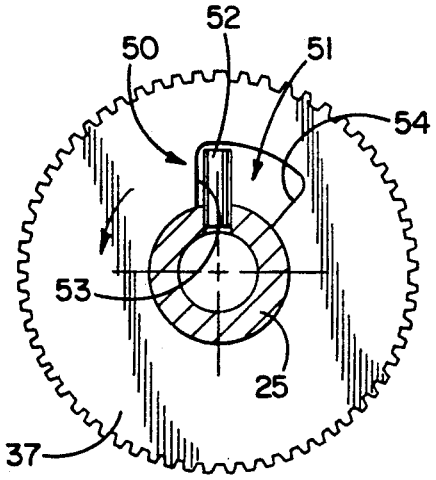
FIG. 5 is an enlarged view of the output gear and the output shaft shown in FIG. 3.
Figure 6:
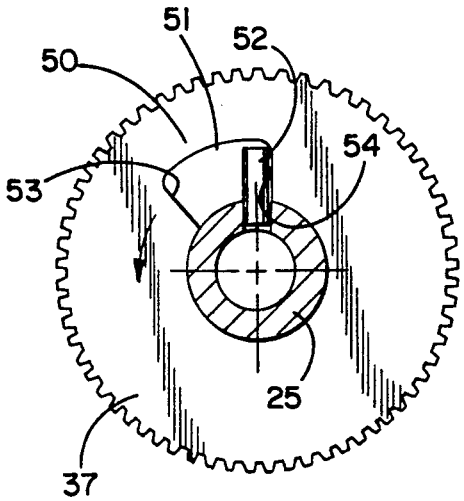
FIGS. 6 and 7 are views similar to FIG. 5 but show the output gear and the output shaft in successively moved positions.
Figure 7:
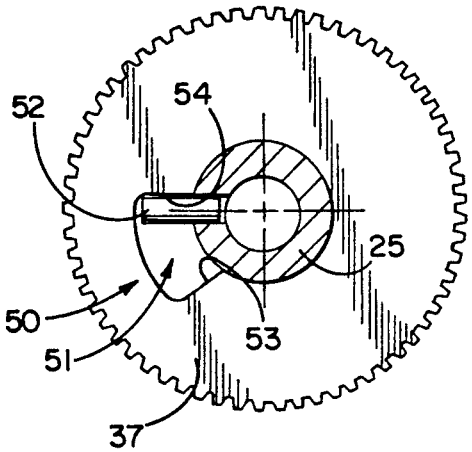

FIG. 5 shows the position of the pin 52 on the output shaft 25 with respect to the slot 51 in the output gear 37 after the motor 30 has been de-energized and after the spring 31 has rotated the output shaft clockwise to bring the damper 21 to its fully closed position against the stop 26. As shown, the pin is spaced a slight distance from the end 53 of the slot and a substantial distance from the opposite end 54 of the slot. Now assume that the motor is energized to rotate the output gear 37 in a counterclockwise direction. During initial counterclockwise rotation of the output gear, the latter simply rotates on the output shaft 25 and takes up the clearance or lost motion between the slot end 54 and the pin 52 (see FIG. 6). When the lost motion is taken up and the slot end 54 engages the pin, the output shaft 25 is driven counterclockwise to effect opening of the damper. Counterclockwise rotation of the output shaft continues until the damper is fully open and engages the stop 27, at which time the motor stalls with the slot end 54 in engagement with the pin 52 (see FIG. 7).

Assume now that the motor 30 is de-energized to release the output shaft 25 to the action of the spring 31. As the spring turns the shaft 25 clockwise to close the damper, the pin 52 engages the slot end 54 and rotates the output gear 37 clockwise from the position of FIG. 7 toward the position of FIG. 6, the output gear backdriving the gear train 35 and the motor shaft 33. When the damper 21 hits the stop 26 and stops rotation of the output shaft 25, the output gear 37 is free to continue to rotate in a clockwise direction by virtue of the angular clearance between the slot end 53 and the pin 52. Accordingly, the output gear continues to rotate clockwise relative to the stopped output shaft and, during such rotation, continues to backdrive the gear train and the motor. By virtue of the inefficiency of the gears 36–43 and the friction between the gears and the shaft 25 and the pins 44–46, the kinetic energy imparted by the spring 31 to the output gear 37 via the output shaft 25 is dissipated by the gear train and thus the gear train and the motor stop gradually rather than abruptly. Accordingly, impact loading of the gear train and motor components is avoided.

Preferably, the slot 51 is sufficiently long that the output gear 37 comes to a stop before the slot end 53 engages the pin 52 (see FIG. 5). In situations where design considerations might dictate the use of a shorter slot, a spring washer 55 (FIG. 4) may be sandwiched between one side of the output gear 37 and a retaining ring 56 fixed to the output shaft. The spring washer creates braking friction between the output gear and the retaining ring so as to help bring the output gear to a quicker but still gradual stop.

Figure 8:
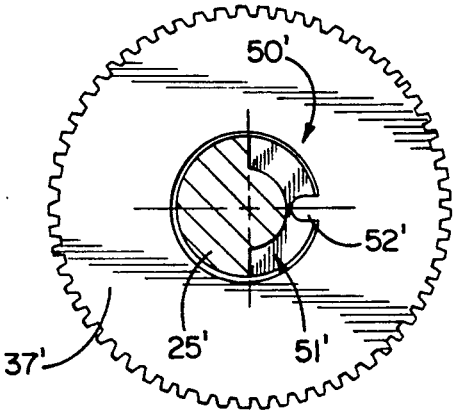
FIG. 8 is a view generally similar to FIG. 5 but shows a modified embodiment.

A modified lost-motion drive connection 50' is shown in FIG. 8 and functions essentially the same as the lost-motion drive connection 50. In this instance, however, a slot 51' is formed in the outer periphery of the output shaft 25' while a projection 52' is formed on the inner periphery of the output gear 371 and extends radially inwardly into the slot. When the shaft 25' stops after having been driven in a clockwise direction by the spring 31, the projection 52' travels within the slot 51' to allow the gear 37' to rotate relative to the shaft and dissipate energy.

Figure 9:
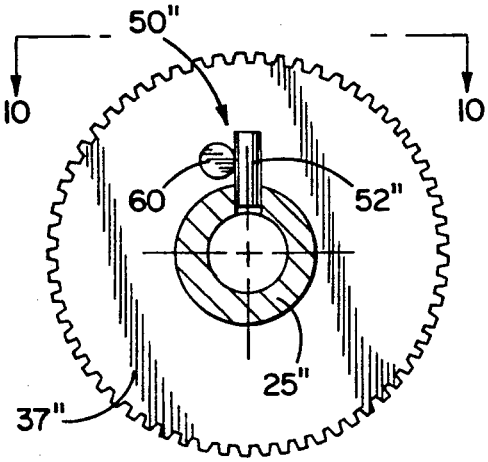
FIG. 9 also is a view generally similar to FIG. 5 but shows another modified embodiment.
Figure 10:
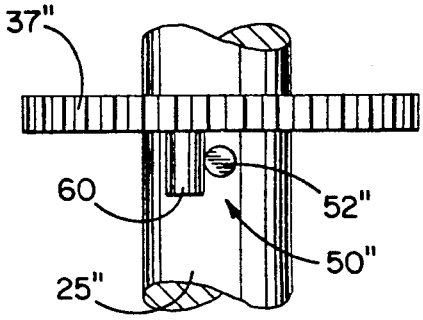
FIG. 10 is a view as seen along the line 10—10 of FIG. 9.

Still another form of a lost-motion drive connection 50'' is illustrated in FIGS. 9 and 10. As shown, the gear 37'' carries an axially projecting drive lug or pin 60 which is adapted to rotate into and out of driving engagement with a radially extending drive lug or pin 52'' affixed to the shaft 25''. When the shaft is rotated clockwise by the spring 31, the pin 52'' engages the pin 60 to rotate the gear 37''. When the shaft is stopped, the gear continues to rotate clockwise with the pin 60 moving angularly away from the pin 52''. While this arrangement occupies more space in an axial direction, it allows the gear to rotate through an angle of almost 360 degrees after the shaft stops.

From the foregoing, it will be apparent that the present invention brings to the art a new and improved motor-driven, spring-returned actuator in which the lostmotion drive connection enables the drive train to dissipate energy after the output shaft is abruptly stopped. The cost involved in incorporating the extremely simple components of the lost-motion drive connection in the actuator is low and thus impact loading of the gear train and motor can be avoided in a very inexpensive manner.

I claim:

1. A reversible actuator comprising a selectively energizable electric motor having a rotatable drive shaft, a rotatable output shaft, a gear train having an input gear adapted to be rotated by said drive shaft and having an output gear adapted to rotate said output shaft in one direction when said motor is energized, a torsion spring connected to said output shaft and adapted to be wound when said output shaft is rotated in said one direction, said torsion spring unwinding and rotating said output shaft in the opposite direction in response to de-energization of said motor, and lost-motion connection means between said output shaft and said output gear, said lost-motion connection means causing said output gear to rotate said output shaft in said one direction when said motor is energized, causing said output shaft to rotate said output gear when said spring rotates said output shaft in said opposite direction, and permitting said output gear to rotate relative to said output shaft when the latter is stopped against rotation in said opposite direction whereby the energy imparted to said output gear by said spring is dissipated through said gear train.

2. A reversible actuator as defined in claim 1 in which said lost-motion connection means comprise an angularly extending slot formed in one of said output gear and said output shaft and further comprise a projection extending from the other of said output gear and said output shaft and extending into said slot, the angular dimension of said slot being substantially greater than the angular dimension of said projection.

3. A reversible actuator as defined in claim 2 in which said slot is formed in said output gear, said projection extending from said output shaft.

4. A reversible actuator as defined in claim 2 in which said slot is formed in said output shaft, said projection extending from said output gear.

5. A reversible actuator as defined in claim 1 in which said lost-motion connection means comprise a first drive lug projecting radially from said output shaft, and a coacting drive lug projecting axially from said output gear and adapted to rotate into and out of driving engagement with said first drive lug.

6. A reversible actuator as defined in claim 1 further including spring means acting between said output shaft and said output gear and creating friction resisting rotation of said output gear on said output shaft.

7. A reversible actuator comprising a selectively actuatable motor having a rotatable drive shaft, a rotatable output shaft, a drive train having an input member adapted to be rotated by said drive shaft and having an output member adapted to rotate said output shaft in one direction when said motor is actuated, a spring connected to said output shaft and adapted to be loaded when said output shaft is rotated in said one direction, said spring unloading and rotating said output shaft in the opposite direction in response to de-activation of said motor, and lost-motion connection means between said output shaft and said output member, said lost-motion connection means causing said output member to rotate said output shaft in said one direction when said motor is actuated, causing said output shaft to rotate said output member when said spring rotates said output shaft in said opposite direction, and permitting said output member to rotate relative to said output shaft when the latter is stopped against rotation in said opposite direction whereby the energy imparted to said output member by said spring is dissipated through said drive train.

* * * * *